United States Patent [19]

Fleissner

[11] 4,247,294

[45] Jan. 27, 1981

[54] PROCESS AND DEVICE FOR CONTINUOUS WASHING OF TEXTILE WEBS

[75] Inventor: Hans Fleissner, Riehen, Switzerland

[73] Assignee: Vepa Aktiengesellschaft, Switzerland

[21] Appl. No.: 17,277

[22] Filed: Mar. 5, 1979

[30] Foreign Application Priority Data

Mar. 4, 1978 [DE] Fed. Rep. of Germany ..... 2809433
Mar. 9, 1978 [DE] Fed. Rep. of Germany ..... 2810162

[51] Int. Cl.[3] ..... D06B 3/24; D06B 5/08; D06L 1/08

[52] U.S. Cl. ..... 8/137; 8/151; 8/151.2; 8/152

[58] Field of Search ..... 8/137, 151, 151.2, 152

[56] References Cited

U.S. PATENT DOCUMENTS 3,997,291 12/1976 Fleissner ..... 8/137

*Primary Examiner*—William F. Hamrock
*Attorney, Agent, or Firm*—Craig & Antonelli

[57] ABSTRACT

A process for the continuous washing of printed dye-fixed, web-shaped textile material, e.g. woven or knit fabrics formed of natural and/or synthetic fibers, on a full-width washing machine which involves first moistening the textile material, allowing the textile material to dwell in a folded condition, the dewatering of the textile material and immediately thereafter subjecting the textile material to an intensive throughflow from the outside toward the inside of a washing material on a rotating sieve drum. In this process in order to promote the swelling of the printing paste or the like, the textile material dwells in a cold liquor and then a film detachable from the textile material which covers the textile material is removed mechanically and thereafter the textile material is subjected to the intensive throughflow with a hot liquid on the sieve drum.

12 Claims, 4 Drawing Figures

PROCESS AND DEVICE FOR CONTINUOUS WASHING OF TEXTILE WEBS

The invention relates especially to a process for the continuous washing of printed and already dye-fixed, web-shaped textile material, such as woven or knit fabrics of natural and/or synthetic fibers on full-width washing machines wherein the textile material is first moistened, then dwells in folded condition, is dewatered, and immediately thereafter is subjected, in preferably several washing stages, intensively to a throughflow from the outside toward the inside on rotating sieve drums.

Such a process is described in detail in DAS [German Published Application] No. 2,166,718. The advantage of this process resides in that it has been possible for the first time thereby to also wash printed textile material in a continuous fashion to remove the printing paste. This presents difficulties because the pastes necessary for the printing step and the residual dye components after the dye fixation can be removed from the textile material only under great difficulties, and if the washing step is carried out improperly, there is the danger that the contours of the printed pattern become blurred. An especially dangerous phenomenon is the spotting of darker color patterns at areas of lighter patterns, as well as the white background. The conventional process proposes first to rinse the textile material, from which the printing pastes are to be removed, and to discharge the thus-produced dirty water. Even though this step effects the rough removal of immediately detachable printing paste components, this mode of operation requires a large amount of water. It has been found that even an intensive preliminary rinsing procedure in several stages does not detach dye residues sufficiently well from the textile material; rather it is necessary for this purpose to cause an initial swelling of the printing paste, and this is a time-consuming process.

In the continuous removal of printing pastes following the dye fixation step, it is correct to have the textile material dwell first of all for a rather long period of time in a liquid. To save water, it has been suggested to apply only such an amount of liquid to the textile material that it is sufficient for the thickener to swell so that, in the subsequent process stage, the removable printing paste can be detached from the textile material. In this connection it is expedient to have the textile material, with this small amount of liquor, remain in the air, preferably in suspended loops. This process is definitely advantageous, because the textile material does not come into contact with neighboring parts of the textile material during the dwell period, but it requires a larger-size mechanical installation.

The invention is based on the problem of developing a process, but also an apparatus, making it possible, under consideration of the difficulties in the washing of printed textile material, to remove with certainty the residual dye components which can be washed out, in a maximally rapid manner and in a way which is safe for the color fastness of the textile material; in such a way that the printed pattern is not discolored by the washing step even in the light-colored portion and that also a textile material is obtained having a flawless degree of fastness. This method, which can be conducted in a continuous fashion, is to be effected on a compact apparatus which takes a minimum of space and operates automatically without personal supervision.

Starting with the process described in the foregoing, the thus-posed problem has been solved by providing that the textile material, no matter of which type and no matter what kind of printing dye has been used, is made to dwell in a cold liquor for an initial swelling of the printing paste and the like; then the film covering the textile material, which has thereby been made detachable from the textile material, is removed mechanically; and only thereafter the textile material is subjected to a throughflow of a hot liquor, with the addition of auxiliary agents, on the sieve drums. In this process, a clear demarcation line has thus been drawn between the washing step proper, which is to be considered a chemical washing process and is effected with hot liquor, and the step for the initial swelling of the printing paste, wherein generally no chemicals are employed. The realization on which the invention is based is thus that, for the initial swelling of the printing paste a higher temperature is not required, and at least is not advantageous. For under the effect of raised temperatures, the danger of bleeding and thus spotting is higher, whereas the swelling process is only affected thereby in a qualified sense.

As furthermore provided by the invention, the textile material is subjected, before it is deposited for dwelling underneath the cold liquor, only to such an amount of cold liquid that it is sufficient for moistening and a properly conducted flushing of the textile material for depositing same. This moistening step does not produce any great water loss, especially because in this case this quantity of liquid is not immediately discharged as waste water after the moistening step but rather the textile material remains, in the form of folds, in this cold liquor; in this connection, a folded condition of 1:100 should not be exceeded; a compression ratio of 1:60 is advantageous.

It is expedient to place the stacked-up folds in motion during the dwelling of the textile material, though only to a minor extent. This can be accomplished by means of a current of liquid, in that the folded textile material is exposed underneath the liquor from the bottom and/or from the top to focused liquid jets. It is advantageous to produce such current alternatingly from the top and from the bottom, for which purpose it is not necessary to utilize fresh water. However, it is also expedient as an additional feature to expose the textile material, which is continuously conveyed during the dwell step, to a periodic pressure impulse in the conveying direction in order to prevent the textile material from remaining in absolutely one and the same position during the dwell step.

Subsequently to the cold dwelling step, the swollen printing paste must be removed from the textile material in a way maximally gentle to the fibers, before the material comes into contact with hot liquor. A removal can take place with the aid of a pair of squeeze rolls. Beforehand the textile material should be sprayed with fresh water to dilute the paste. The squeezed-out liquid must be discharged as dirty water.

Since this way of removing the paste can be compared to a type of padder, because the paste to be removed accumulates as a pile of dirt on front of the pair of squeeze rolls, it is more advantageous to arrange a suction removal means at this point. For a continuous transport without tension, the textile material to be cleaned should be guided during the suction removal step on a liquid-permeable, rotating drum, preferably a sieve drum, and should be exposed during this step in the zone of a suction slot to a strong suction draft which directly removes the printing paste without the additional application of washing liquid. In this connection, it is advantageous to produce the suction draft at the face side of the textile material, here again in order to avoid contamination of the printed patterns by removable printing pastes.

Subsequently to the mechanical removal of the swollen printing paste, the fastness washing step begins. This process is connected with the addition of chemicals and a hot liquor. According to this invention, several sieve drum washing baths are proposed for this purpose, which are under a suction draft; after having been passed therethrough, almost 90% of the printing pastes has been removed from the textile material.

It is advantageous to subject the textile material subsequently to this first washing step to another dwell period under a bath, but in this instance, contrary to the first process step, under a hot, if possible boiling, liquor. The same treatment procedure is carried out as described above, i.e. the dirt which has now become available for removal must be eliminated mechanically, such as by a squeezing step, and then the textile material is subjected to an intensive throughflow on sieve drums under a suction draft, the medium being a hot cleaning fluid.

In the treatment device for the continuous finishing of textile lengths there is the problem of transporting the fabric with a minimum of tension. The longitudinal stretching occurring during transport changes the texture of the material and the dense mesh structure which is desirable in most cases. This holds true especially if the textile material is wet-treated and then must finally be pulled to a dewatering device. During this step, the textile material, heavily laden with liquid, is elongated in most instances, which results is quality losses, especially in case of knit fabrics. In the process according to the invention, it is suggested to deposit the textile material, for the wet or heat treatment, on an endless belt in folds, to obtain, by the stacking of the material into a pack, a longer dwell time with a smaller treatment apparatus. To take off the textile material from the stack of folds, sensors of various types are utilized which react respectively to the tension of the material during take-off. The speed of the textile material to be taken off from the transport means must be controlled independently of the feed, because the textile material changes its dimensions during treatment, i.e. it shrinks. The shrinking value, however, is always fluctuating and cannot be calculated beforehand.

All conventional processes and/or devices for determining the necessary take-off speed of a textile material from a stack of such material are connected with the production of an additional longitudinal stretching of the textile material. This elongation, which cannot be avoided, is produced by the fact that the tension present in the material is measured by means of a scanner or the like responsive to pressure and, by means of the scanning result, the take-off speed of the textile material is controlled by way of an electric control device by means of a pair of pressure rolls. However, since such additional elongation values are to be avoided if at all possible, the conventional devices for controlling the take-off speed are unsatisfactory. Another reason therefor is the control which, seen over a longer period of time, is uncertain, especially because the tension of the material is always changing since it is taken off from a folded condition.

Therefore, in one embodiment of the present process, the take-off speed of the textile material from the conveyor means is to be controlled in dependence on the pressure exerted by the stack of material on the conveyor means against a pressure sensor responsive to resistance. Thus, the tension of the material during take-off of the textile material from the conveying means is entirely ignored, which is of advantage insofar as the tension of the material varies constantly when, for example, a length of material is pulled off from a folded condition; rather, the amount of material disposed on the conveying means and moved thereby is chosen as the yardstick for the take-off speed, which results in the above-described advantages.

The apparatus necessary for the utilization of this novel process consists essentially of known machine parts. First of all, a dwell bath is to be provided wherein the textile material is deposited in pleats underneath the level of the bath and can reside therein for a rather long period of time. To ensure continuous transport underneath the liquor, two endless conveyor belts are arranged in the bath, the textile material being held in the folded condition between the loaded sides of these belts arranged in parallel to each other and below the level of the bath, which belts rotate in the same direction. In this way, a uniform conveying action is provided with certainty even if the degree of pushing the folds together is not too large.

In front of this dwell unit, it is merely necessary to arrange a device for the sufficient moistening of the textile material. Together with this wetting fluid, the textile material, which is merely moistened, is simultaneously flushed into the dwell bath.

The outlet of a dwell bath consists of a press which is directly preceded by a spray device to dilute the printing paste film. The dirty fluid is to be removed. However, it is more advantageous to arrange at this location a suction removal means which, without fresh water, removes the printing paste film directly with the aid of a suction slot of intensive power. In this connection, it is advantageous to treat the textile material with the suction draft on the face side, i.e. on the printed side.

Following this first dwell unit, sieve drum washing bands must be arranged, as is known, which in contrast to the dwell step are operated with hot liquor and with the addition of chemicals. Here the fastness washing process begins. To complete this type of washing step, it is advantageous to have the sieve drum washing bands followed by a further dwell unit of the same type, but provided with a housing closed all around, so that is can be operated at boiling temperatures. Thus, in this unit the material dwells under high-temperature conditions. A subsequent washing step with an intensive throughflow of the material on sieve drums under a suction draft is then executed. Between each sieve drum unit, a press is suitably arranged.

A novel feature of the process of this invention resides in that the textile material is to be exposed to a compressive pressure in a pulsating manner within the dwell unit. This is possible in a simple manner in a device with a slide for laying the material into folds, by associating the end of the slide in closest proximity to the endless belt with such belt in a reciprocating fashion. In this connection it is advantageous to have this slide terminate directly above the endless belt. By means of this device, the object is to be attained that the respectively upper end of a stack of folds built up during the deposition of the textile material is moved to and fro with respect to the dropping textile material. Thus, it is not the arriving textile material which is to be moved to and fro for depositing, but rather it is the folded stack which is in motion, at least the upper end moves with respect to the freely dropping textile material. In this way with each reciprocating movement of the slide, the entire stack of folds lying on the endless belt and supported against the slide is vibrated in a pulsating manner and thereby is introduced uniformly below the bath level. Due to the motion of the slide, however, there is not only a continuous deposition, but furthermore a washing treatment is produced in the liquid by means of a pumping action, because the pressure is transmitted via the stack of folds to the entire length of the compression channel in the washing bath. In the compression channel, the textile material is constantly compressed to a slight extent and then immediately thereafter relieved again.

For the purpose of effecting the deposition of the introduced textile material as desired, a feed roller arranged above the slide is associated with the latter so that the deposition of the textile material takes place somewhat above the end of the slide associated with the endless belt or the like. The depositing zone of the textile material should thus be adjusted to be at a spacing above the endless belt, so that also the upper end of the stack of folds can move to and fro in a swinging motion.

The slide is advantageously liquid-permeable so that the washing liquor does not offer any resistance to the reciprocating motion of the slide, which latter is immersed in the liquid. It is advantageous to form the slide from round bars arranged at mutual spacings.

While the slide takes care at the inlet for the pulsating motion of the stack of folds, the take-off device at the outlet is controlled by a potentiometer regulated in dependence on the amount of textile material to be withdrawn. Regulation takes place advantageously by means of a pressure sensor which is arranged at the level of the textile material deposited on the conveying means so that is can be moved forwards and backwards.

When taking off a textile material accumulated into a stack, there is always the danger that the textile material cannot be taken off smoothly, and that knots are produced or folds are not pulled apart. This is true the more so, if a guide roller is provided with the formation of an angle at the level of the take-off point of the textile material in the stack of material. According to the invention, this problem at the take-off point can be circumvented by arranging a take-off roller for the textile material at the pressure sensor proper, above the pressure sensor and above the stack of material, and by locating this take-off roller preferably approximately on the connecting line between the take-off point of the textile material from the stack of material and the articulation point of the pressure sensor to its movable mounting. The textile material can easily be stretched along the way between the take-off roller and the take-off point.

The pressure sensor is controlled with respect to its angular position in dependence on the pressure exerted by the stack of material and also in dependence on the unavoidable pulling action on the material when it is taken off by way of the guide roller. To control these forces, the invention provides in one embodiment that the pressure sensor is arranged to be movable above the stack of material on tracks along the conveying means, wherein suitably the tracks extend in the conveying direction obliquely downwardly to provide a restoring force acting against the tension on the material.

The drawing shows embodiments of a washing device to conduct the process of this invention, to wit:

Figure 1:
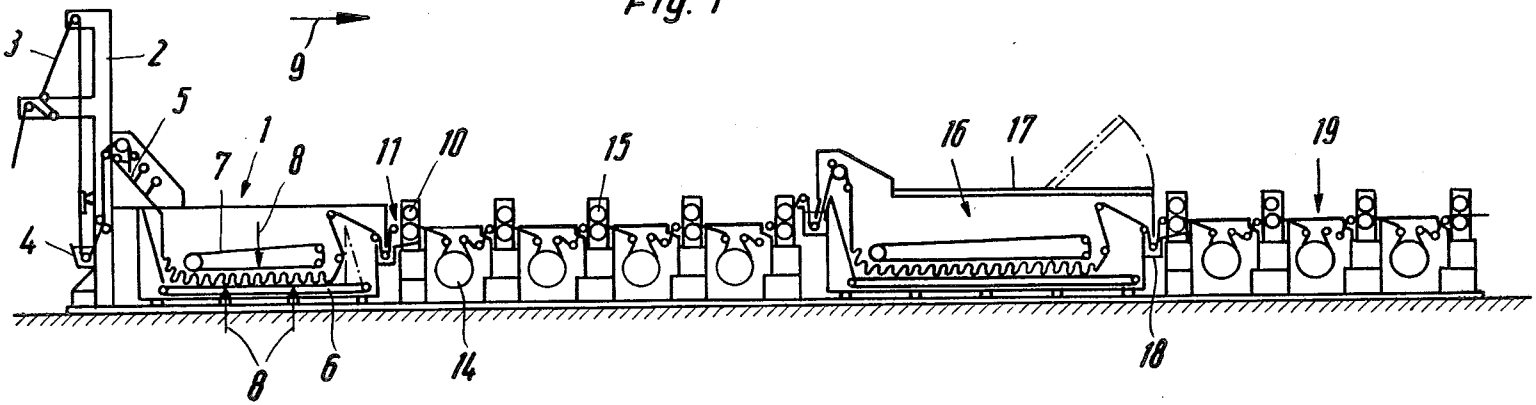
FIG. 1 shows the total plant in a longitudinal sectional view.

The inlet of the plant in total is constituted by a gallows 2 from which the textile material 3 is conveyed first optionally through a moistening bath 4 and then over a slide 5 where it is charged on both sides with such an amount of liquid that the textile material is sufficiently saturated and can be deposited in stacks without problems. Only such a quantity of fresh water flows into the dwell bath 1 as necessary for moistening the textile material.

In the dwell bath 1, two endless belts 6, 7 are arranged which convey with their associated load sides the textile material, deposited in folds, uniformly and without great pressure stresses through the bath and maintain the textile material underneath the bath during this step. It is advantageous to expose the folded stack to a liquid flow by means of nozzles 8 and optionally also expose the stack in the conveying direction 9 to a pressure in a pulsating fashion.

Figure 2:
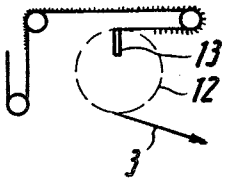
FIG. 2 shows on an enlarged scale a suction removal means instead of a press.

A squeeze means 10 constitutes the outlet of the dwell bath, preceded by a spray means 11. The squeezed-out dirty water is removed. At this point, the suction removal device illustrated in FIG. 2 is more advantageous, which device consists of a sieve drum 12 with a suction slot 13. The suction slot 13 is arranged on the topside of the sieve drum 12. The textile material 13 is conducted over this slot in the downward direction with its face side, i.e. the printed side, so that the printing paste can be taken off directly by suction and is not sucked through the textile material.

The dwell unit with squeeze means and/or suction removal means is followed by the machine units required for the fastness washing step. These units consist of several sieve drums 14 under a suction draft each being followed by a squeeze means 15, a further dwell unit 16 with a housing 17 closed all around, so that this latter unit can be operated at boiling temperatures without impairing the operation. The dwell unit 16 ends with a water lock 18 with an associated squeezer. Additional washing baths 19 then terminate the washing plant.

Figure 3:
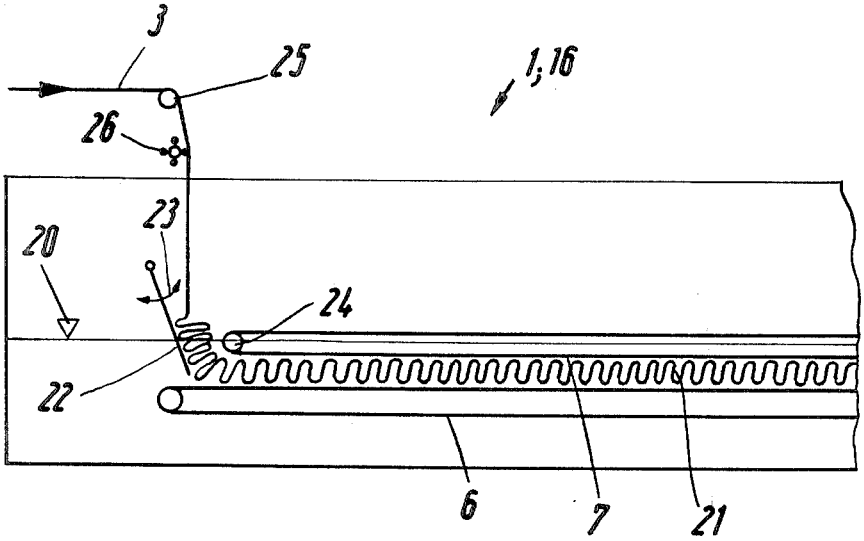
FIG. 3 shows the inlet to a dwell bath according to FIG. 1.

At the inlet of the dwell bath 1 according to FIG. 3, wherein the dwell channel 21 extends underneath the level 20 through the two endless belts 6, 7, a slide 22 is arranged consisting of spaced-apart round bars; this slide is pivotably mounted in accordance with arrows 23. This slide can also be moved in total in parallel to itself in a reciprocating fashion. The lower edge, namely the free end of the slide 22, terminates directly above the load side of the endless belt 6 so that a fold-forming duct is formed between the set-back guide roll 24 of the endless belt 7 and the slide 22 immersed in the liquid. Thereby, a continuous transfer of the folded stack into the dwell channel 21 is ensured, which by the way is also done by the feature that the guide roller 24 slightly seizes the folded on one side and deflects same into the horizontal, while it slides on the other side along the slide 22 and is seized by the endless belt 6.

However, the continuous change in the cross section of the fold-forming channel is of importance. On the one hand, the upper end of the stack of folds is moved to and fro with respect to the textile material dropping from the guide roller 25, so that the material is deposited in the respectively desired folds due to the feeding speed. On the other hand, the folded stack receives an intermittent impulse by the motion of the slide 22 in the longitudinal direction of the dwell channel 21, whereby the moving stack of folds has superimposed thereon a slight, constantly changing compressive motion. Due to this pumping effect in the longitudinal direction, the load sides of the endless belts 6, 7 buck upwardly time and again in a corresponding fashion, so that also in the transverse direction of the folded stack a pumping motion is generated.

To reduce coiling at the guide roller 25, a beater roll 26 is arranged below the guide roller; this beater roll must merely take care of detaching the length of material 3 continuously from the roller 25 by means of beater-like motions.

Figure 4:
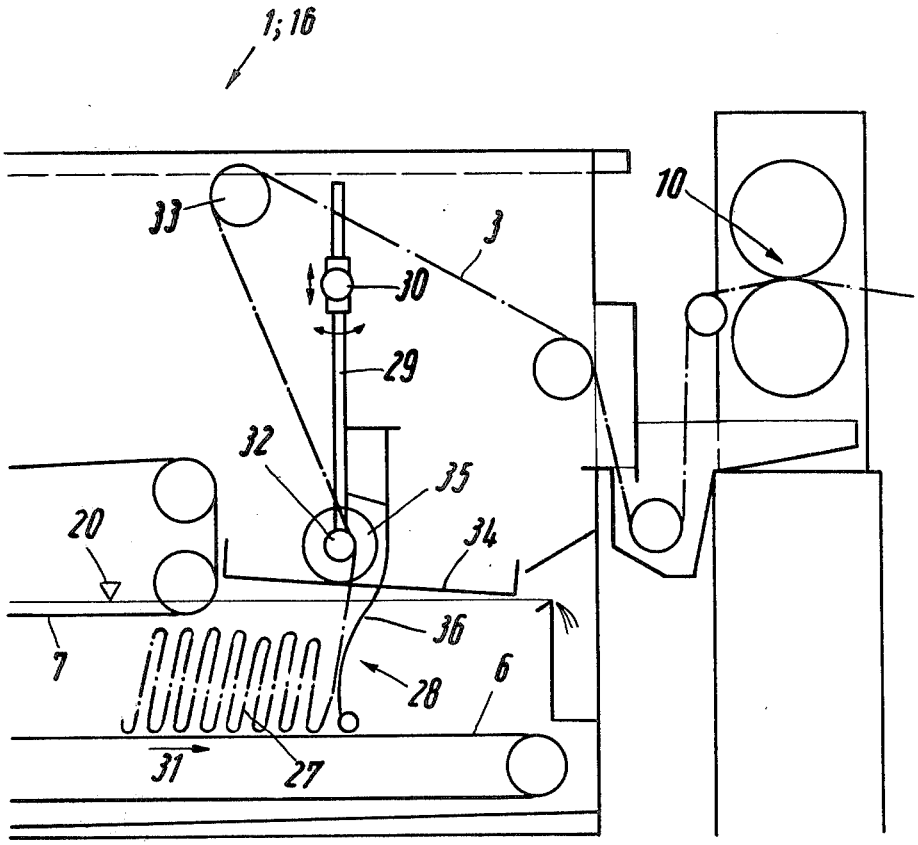
FIG. 4 shows the outlet from a dwell bath according to FIG. 1.

The outlet of the dwell bath 1 or 16 is illustrated in greater detail in FIG. 4. In this figure, the stack of material 27 runs against a pressure sensor indicated by 28 in its entirety, this sensor being articulated in a vertically adjustable fashion to the point 30 by way of a connecting rod 29. The potentiometer, likewise located at that point, transmits the energy in dependence on the angular position of the pressure sensor, for driving the subsequently arranged pair of pressure rolls 10, which latter takes off the length of material 3 from the treatment apparatus 1 at the desired speed. If too much material is delivered from the stack of material 27 due to the conveying speed 31 of the endless belt 6, then the pressure sensor 28 is pivoted, due to the increased pressure exerted by the stack of material, in the direction of arrow 31. Due to this pivoting motion of the potentiometer, the pair of pressure rolls increases its rotary speed, so that more material is taken off from the sieve belt 6. The reverse is true if the quantity of material offered for take-off is too small.

The respective, inclined position of the pressure sensor at the end of the stack of material is affected by the arrangement of guide rolls in the area of the end of tank 1. A take-off roller 32 is disposed above the stack of material 27 at the pressure sensor 28 proper, namely approximately on the connecting line between the take-off point of the textile material from the stack and the point 30 of articulation of the pressure sensor 28. From there, the material is conducted back to the spreading roller 33, so that the material always exerts a certain pressure in opposition to the conveying direction 31 on the take-off roller 32. As a result, the pressure sensor 28 will continuously be in contact with the end of the stack of material, but this contact is very slight and thus hardly impedes the low-tension take-off procedure.

It is disadvantageous to support the pressure sensor with its weight on its point 30 of articulation or on the endless belt 6. It is expedient to effect this support on an additional plane on which the pressure sensor can be supported during its movement. This plane consists of tracks 34 on which run rollers 35 provided at the connecting rod 29 of the pressure sensor 28. The tracks 34 can be arranged to be inclined to control the pressure of the sensor 28 at the stack of goods in dependence on the tension on the material and in dependence on the relative weight of the pressure sensor. In accordance with the embodiment, the tracks extend so that they are inclined in the conveying direction, there thus being the tendency that the pressure sensor moves in the conveying direction. A take-off procedure which is very low in tension is a result of this measure.

The pressure sensor has the take-off roller 35 for take-off purposes; this take-off roller leaves sufficient space above the liquid and thus above the stack of material to ensure a fold-free withdrawal of the length of material from the stack 27. Furthermore, for troublefree take-off, the pressure sensor is provided with a baffle 36 at the level of the take-off point. This baffle extends over the operating width and offers minimum frictional resistance to the length of material to be taken off. For this purpose, the baffle is bent backwards, i.e. in the conveying direction immediately following the take-off point, and thus leaves enough space toward the take-off roller 35 so that the length of material no longer contacts the baffle 36 at that point.

What is claimed is:

1. Process for the continuous washing of printed and already dye-fixed, web-shaped textile material, such as woven or knit fabrics of natural and/or synthetic fibers, on full-width washing machines wherein the textile material is first moistened, then dwells in folded condition, is dewatered, and immediately thereafter is subjected, in preferably several washing stages, intensively to a throughflow from the outside toward the inside on rotating sieve drums, characterized in that the textile material, for the swelling of the printing pastes or the like, dwells in a cold liquor, then the film detachable from the textile material, which film covers the textile material, is removed mechanically, and only thereafter the textile material is subjected to a throughflow with hot liquid on the sieve drums, with an addition of auxiliary media.

2. Process according to claim 1, characterized in that the textile material, after the hot washing step with medium flowing through the material, dwells again in the folded condition, but in this case in a hot liquor, preferably at boiling temperatures, is then again dewatered, and subsequently exposed repeatedly to the throughflow of a medium on sieve drums under a suction draft.

3. Process according to claim 1 or 2, characterized in that the textile material is charged, before being deposited for dwelling under a bath, only with such an amount of liquid that it is sufficient for moistening and for a satisfactory transport by flushing for depositing purposes.

4. Process according to claim 1 or 2, characterized in that the textile material, deposited in folds, is exposed underneath the bath level to a focused bath current from the bottom and/or from the top, to replace bath liquor during the dwell step.

5. Process according to one or more of claims 1–4, characterized in that the textile material is subjected to a pulsating force in the conveying direction during the dwell step.

6. Process according to claim 5, characterized in that at least the upper end of the building-up stack of folds is moved to and fro with respect to the downwardly dropping textile material.

7. Process according to claim 6, characterized in that the folded stack is compressed in its entirety along the dwell channel in a pulsating fashion, and is then relieved again.

8. Process according to claim 1, characterized in that the textile material with the swollen printing paste or the like is sprayed with liquid subsequently to the dwell step before a squeezing step is conducted.

9. Process especially according to claim 1, characterized in that the swollen printing paste or the like is removed by suction.

10. Process according to claim 9, characterized in that the textile material is guided without tension on a liquid-permeable drum, preferably a sieve drum, during the suction removal of the printing paste or the like.

11. Process according to claim 9 or 10, characterized in that the suction draft for removing the swollen printing paste is effective on the face side of the textile material.

12. Process according to claim 1 or 2 for the continuous control of the take-off speed of the endless length of textile material deposited in folds as a stack of material on a conveying means moving in the transport direction, by means of a take-off device arranged above the conveying means and controlled by a sensor equipped with a potentiometer, characterized in that the take-off speed of the textile material from the conveying means is controlled in dependence on the pressure of the material from the stack on the conveying means against a pressure sensor reacting to a resistance.

* * * * *